US011414900B2

(12) United States Patent
Sturm

(10) Patent No.: US 11,414,900 B2
(45) Date of Patent: Aug. 16, 2022

(54) LOCK FOR A MOTOR VEHICLE

(71) Applicant: Kiekert AG, Heiligenhaus (DE)

(72) Inventor: Christian Sturm, Krefeld (DE)

(73) Assignee: Kiekert AG, Heiligenhaus (DE)

( * ) Notice: Subject to any disclaimer, the term of this patent is extended or adjusted under 35 U.S.C. 154(b) by 172 days.

(21) Appl. No.: 16/605,043

(22) PCT Filed: Mar. 1, 2018

(86) PCT No.: PCT/DE2018/100186

§ 371 (c)(1),
(2) Date: Oct. 14, 2019

(87) PCT Pub. No.: WO2018/192608

PCT Pub. Date: Oct. 25, 2018

(65) Prior Publication Data

US 2021/0095499 A1 Apr. 1, 2021

(30) Foreign Application Priority Data

Apr. 19, 2017 (DE) ..... 10 2017 108 266.2

(51) Int. Cl.
*E05B 81/20* (2014.01)
*E05B 81/16* (2014.01)
(Continued)

(52) U.S. Cl.
CPC ..... *E05B 81/20* (2013.01); *E05B 79/20* (2013.01); *E05B 81/16* (2013.01); *E05B 83/24* (2013.01);
(Continued)

(58) Field of Classification Search
CPC ..... E05B 81/20; E05B 81/14; E05B 81/16; E05B 81/18; E05B 79/20; E05B 83/24;
(Continued)

(56) References Cited

U.S. PATENT DOCUMENTS 10,590,683 B2 * 3/2020 Gumbo ..... E05B 83/24
10,655,367 B2 * 5/2020 Ferri ..... E05B 83/24
(Continued)

FOREIGN PATENT DOCUMENTS

DE 10309643 A1 9/2004
DE 102009010975 A1 * 9/2010 ..... E05B 81/14
(Continued)

OTHER PUBLICATIONS

Computer Generated Translation for DE102014003737A1, Generated on Jan. 25, 2022, https://worldwide.espacenet.com/ (Year: 2022).*
(Continued)

*Primary Examiner* — Alyson M Merlino
(74) *Attorney, Agent, or Firm* — Renner, Otto, Boisselle & Sklar, LLP

(57) ABSTRACT

A method and a locking device for a motor vehicle, in particular a bonnet lock, having a locking mechanism with a rotary latch and at least one pawl, a locking pin and an ejector interacting with the locking pin, wherein the locking pin can be brought into a lifting-off position by means of the ejector, and with at least one electrically actuable means for moving the lock holder from the lifting-off position into a locking position, wherein a drive lever is provided, and wherein the ejector and, at least indirectly, the rotary latch are actuable by means of the drive lever.

18 Claims, 2 Drawing Sheets

(51) Int. Cl.
*E05B 85/26* (2014.01)
*E05B 83/24* (2014.01)
*E05B 79/20* (2014.01)

(52) U.S. Cl.
CPC ..... *E05B 85/26* (2013.01); *E05Y 2900/536* (2013.01)

(58) Field of Classification Search
CPC ..... E05B 83/16; E05B 83/18; E05B 85/20; E05B 85/24; E05B 85/26; Y10T 292/1047; Y10T 292/1082; Y10S 292/23; Y10S 292/14; Y10S 292/43
See application file for complete search history.

(56) References Cited

U.S. PATENT DOCUMENTS

| | | | | |
|---|---|---|---|---|
| 10,669,751 | B2 * | 6/2020 | Kim | E05B 81/20 |
| 10,920,464 | B2 * | 2/2021 | Im | E05B 81/20 |
| 11,015,375 | B2 * | 5/2021 | Lebsak | E05B 83/24 |

FOREIGN PATENT DOCUMENTS

| | | | | |
|---|---|---|---|---|
| DE | 102010061518 | A1 | | 4/2012 |
| DE | 102013109051 | A1 | | 2/2015 |
| DE | 102014003737 | A1 | | 9/2015 |
| DE | 102014109111 | A1 | | 12/2015 |
| EP | 3284885 | A1 | | 2/2018 |
| KR | 20170119013 | A | * | 10/2017 |

OTHER PUBLICATIONS

Computer Generated Translation for DE102009010975A1, Generated on Jan. 25, 2022, https://worldwide.espacenet.com/ (Year: 2022).*

International Search Report and Written Opinion for corresponding Patent Application No. PCT/DE2018/100186 dated Jun. 12, 2018.

* cited by examiner

LOCK FOR A MOTOR VEHICLE

FIELD OF DISCLOSURE

The invention relates to a lock for a motor vehicle, in particular a bonnet lock, having a locking mechanism with a rotary latch and at least one pawl, a locking pin and an ejector interacting with the locking pin, wherein the locking pin can be brought into a lifting-off position by means of the ejector, and with at least one electrically actuable means for moving the lock holder from the lifting-off position into a locking position.

BACKGROUND OF DISCLOSURE

Locks or locking systems for motor vehicles are used where doors, hatches or movable components on motor vehicles need to be retained in order to ensure that the motor vehicle can be safely driven. The locking systems serve primarily to retain the movable components in the locked position thereof, and so an increasing number of convenience functions are coming to the fore nowadays. In this sense, for example, doors, hatches or bonnets may be electrically actuated during the opening and/or closing process, as a result of which the locking system is opened and/or the movable component is closed in an electrically assisted manner.

In addition to the convenience properties of electrically actuated locking systems, the operating and usage properties of motor vehicles change for example if motor vehicles are equipped with electric drives, for example. Even though there may be few motor vehicles nowadays that have a luggage compartment arranged under the front bonnet, for example, as part of the trend towards vehicles comprising electric drives it is becoming increasingly common for the resulting free space to be used as a luggage compartment. Here, a luggage compartment can be sealed by means of a seal, such that it is sealed against water or dirt, for example. Sealing requires that counter-pressure acts against the locking mechanism when locking the lock. Locking systems for electrically locking a lock are known from the prior art.

German patent application DE 10 2013 109 051 A1 discloses an electrically actuable lock that is concerned with minimizing gaps or joins in doors or hatches. The lock known therefrom is movable, and in particular is pivotally mounted. After latching the locking mechanism, the lock is moved or pivoted as a whole by a drive such that a gap between the door or hatch and the bodywork is minimized. The drive provided for this purpose comprises an electric motor and a pivotable lever, referred to as the swinging body. By pivoting the swinging body by means of the electric motor, the lock is pivoted as a whole such that the gap is minimized. In the process, the lock housing is retained by a pawl, which is rotatably attached to the swinging body. The locking device known from this document thus comprises a drive by means of which the lock as a whole, and therefore also the locking mechanism, can be moved such that a door gap or hatch gap can be reduced after a door or hatch is closed.

DE 10 2014 109 111 A1 discloses an electrically actuable bonnet lock, having a locking mechanism with a rotary latch and at least one pawl for latching the rotary latch and an electric drive for moving components of the locking device, with a disk cam that is rotatable by the electric device and can move by a rotary movement of a plurality of components being known. By pivoting a transmission lever about its shaft, the position of the rotary latch can be raised and lowered in order to make it possible to modify a gap between the bonnet and the bodywork after latching. In order to prevent anything becoming trapped during the locking, the bonnet is supported on an ejector lever during the locking process, after which the bonnet is lowered again by means of an electric motor, with the ejector lever being lowered. In this phase, the bonnet can be raised at any point, since the rotary latch is not yet latched. There is therefore no risk of fingers becoming trapped. Only after reaching a gap of approx. 4-8 mm is the rotary latch pivoted into its latching position, so that the bonnet is pivoted into its locking position by the rotary latch being electrically driven. The structural complexity of the closure and the new requirements in relation to overcoming sealing pressure pose new problems in terms of development. This is where the invention starts from.

SUMMARY OF DISCLOSURE

The technical problem addressed by the invention is to develop a motor vehicle lock of this kind so that sufficient lift can be provided for rapid lowering and, at the same time, sufficient force can be made possible for closing the lock against the force of a seal. Furthermore, the problem addressed by the invention is to provide a structurally simple and cost-effective locking system.

The problem solved by the features of the disclosure. Advantageous configurations of the invention are found in the dependent disclosure. It is noted that the exemplary embodiments described in the following are not limiting, but rather any possible variations of the features in the description. According to the disclosure, the problem address by the invention is solved by providing a lock for a motor vehicle, in particular a bonnet lock, having a locking mechanism with a rotary latch and at least one pawl, a locking pin and an ejector interacting with the locking pin, it being possible to being the locking pin into a lifting-off position by means of the ejector, and with at least one electrically actuable means for moving the lock holder from the lifting-off position into a locking position, wherein a drive lever is provided, and wherein the ejector and, at least indirectly, the rotary latch are actuable by means of the drive lever.

Owing to the design of drive kinematics according to the invention, there is now the option of securely moving the lock holder from the lifting-off position into a locking position. In the process, the drive lever first acts on the ejector and moves the ejector at least in regions, in order to then interact with the rotary latch, at least indirectly, and to move the rotary latch into the locking position. The alternate interaction between the drive lever, ejector and rotary latch provides the option of configuring the engagement ratios between the drive lever, ejector and rotary latch to be adjustable. Here, the engagement ratios can be configured to be adjustable by means of different gear or mechanical ratios between the drive lever and the ejector, and the drive lever and the rotary latch, so that the movements and in particular the forces introduced into the kinematics can be adapted to the circumstances of lowering and sealing closure, which is described in greater detail in the following.

Bonnet locks are preferably used here as locking systems for motor vehicles. It is however conceivable for the lock according to the invention to be used in hatches, covers, sliding doors or side doors. The motor vehicle locks covered by the invention are used where electrical actuation, i.e. electrically assisted closing and/or opening, is intended to be provided.

Common to all of these locking systems is a locking mechanism with a rotary latch and at least one pawl, it being possible to retain the rotary latch in a locked position by means of the pawl. Single-stage lock mechanisms consisting of a pre-ratchet and main ratchet, as well as systems comprising one or two pawls, are used here. Preferably, the invention is directed to a locking mechanism having a main ratchet position and a pawl, but this is not limiting.

The locking mechanism interacts with a locking pin. The locking pin can be fastened to the motor vehicle bodywork or can be mounted on a hatch or bonnet, for example. If, for example, the locking system is used in the region of a bonnet, the locking pin and/or the lock holder are preferably mounted on the bonnet. The bonnet is then locked by the bonnet being moved towards the locking system and resting on an ejector.

The ejector is part of the motor vehicle locking system and interacts with the locking pin, it being possible to bring the locking pin into a lifting-off position by means of the ejector. In this case, the lifting-off position is the position in which the bonnet, for example, rests on the ejector and is retained in the lifting-off position by the ejector. Preferably, the ejector is spring-tensioned. After opening the locking mechanism and thus releasing the locking pin, the locking pin can be moved into the lifting-off position by means of the ejector and in particular by the force of the spring acting on the ejector.

The lock comprises an electrically actuable means for moving the lock holder out of the lifting-off position into a locking position. Here, the locking position is determined in that the lock holder and thus the movable component can be retained in a secured position on the motor vehicle. The bonnet, door and/or hatch is closed. The lock holder is retained in the locked locking mechanism and is preferably in the main ratchet position.

To move the lock holder from the lifting-off position into the secured position, a drive lever can be brought into engagement with the ejector. The drive lever is electrically actuable and is capable of moving the ejector and thus the lock holder into the secured position against the force of the spring. Only when the secured position is reached, in which anything becoming trapped can be prevented, does the drive lever interact with a closure lever so that the lock holder can be moved from the secured position into the locking position.

An advantageous design variant is produced when a closure lever is provided and the drive lever alternately interacts with the ejector to move the lock holder from the lifting-off position into a secured position and interacts with the closure lever to move the lock holder from the secured position into the locking position.

It may also be advantageous and constitute an embodiment of the invention if the drive lever is actuable by means of a closure drive. The use of a separate closure drive makes it possible here for large forces to be introduced into the drive lever. Therefore, although different force ratios are required during lowering, i.e. in the phase of moving the lock holder from the lifting-off position into the secured position, rapid movement of the lock holder can be achieved with a small gear or mechanical ratio, while large forces can be provided for a high gear or mechanical ratio during the closure by means of the closure drive. In particular, it may be advantageous for the closure drive to comprise a Bowden cable, it being possible to bring the Bowden cable into engagement with the drive lever. By using a closure drive in combination with a Bowden cable, the option is provided of arranging the closure drive so as to be spaced apart from the locking system, and this in turn has an advantageous effect on the installation conditions of the lock.

If the drive lever is pivotally mounted in a lock case, this results in another design variant of the invention. By mounting the drive lever in the lock case, the number of components belonging to the kinematics can be reduced and the engagement ratios between the drive lever, ejector and closure drive can be adjusted in an advantageous manner. In particular due to the attachment to the lock case, which is preferably made of sheet steel, it can be ensured that the drive lever is securely mounted. Advantageously, the ejector is also pivotally mounted in the lock case.

By additionally and separately mounting the ejector so as to be spaced apart from the drive lever, the lever ratios and thus the gear or mechanical ratio between the drive lever and the ejector can be easily adjusted. In particular, the engagement ratios between the drive lever and the ejector can be adjusted by an elongate extension of the ejector starting from a bearing point of the ejector to a first contact surface of the lock holder on the ejector.

Preferably, the drive lever is pivotally received in the lock case between the bearing point and the first contact surface of the ejector. Furthermore, the ejector may comprise a second contact surface, in which the drive lever engages by means of a catch. The second contact surface is arranged between the bearing point of the ejector and the bearing point of the drive lever in this case. The gear or mechanical ratio on the ejector can thus be adjusted by means of a pivoting movement of the drive lever and engagement of the drive lever on the second contact surface by means of the catch.

If the closure lever can be mounted in the drive lever and the drive lever can be guided in the closure lever, this results in another design variant of the invention. By being guided in the closure lever, the drive lever can be moved independently of a movement of the closure lever, at least in regions. At the same time, the guidance in the closure lever can serve as a support for the closure lever in the lock. The number of components in the lock can thus be reduced. In addition, the ejector may comprise a guide pin for the closure lever so that the closure lever can be supported and guided in regions in the lock at least by the ejector and the drive lever.

An embodiment of the invention then results if the ejector and the closure lever can be moved by means of the drive lever at different gear or mechanical ratios. Arranging the drive lever between the bearing point of the ejector and the engagement region of the lock holder on the ejector allows for a small gear or mechanical ratio of the drive lever on the ejector. A high gear or mechanical ratio can be introduced into the closure lever by means of a point of action of the drive lever on the closure lever that is spaced further apart from the rotary shaft of the drive lever than the spacing between the bearing point of the drive lever and an engagement point on the ejector. Therefore, a high force is provided for closure in the kinematics and for moving the lock holder into a locking position, in particular against the force of a seal. Therefore, owing to the position of the engagement points and the arrangement between the drive lever, ejector and closure lever, the gear or mechanical ratio can be adjusted to the force and torque ratios required for closing the lock.

In fact, the ejector and the closure lever can be moved by means of the drive lever at different gear or mechanical ratios, the drive lever lifting by preferably a third of its actuation travel during the movement of the ejector and lifting by preferably two thirds of its actuation travel during the movement of the closure lever, and the lock holder lifting by preferably less than 25 mm and more preferably by 18 mm during the movement into the secured position and the lock holder lifting by preferably less than 10 mm and more preferably by 6 mm during the movement into the main ratchet position. Owing to the preferred, but not ultimately limiting, selection of the gear or mechanical ratio, the lock holder can move rapidly during the passive lowering, while a high locking force is provided during the active closure, in order to lock the bonnet or sliding door, for example, against the resistance of a seal.

The actuation travel of the drive lever, given by way of example, of course should not be understood to be limiting. The ratios may be modified depending on the structural circumstances and the area of application of the lock, in particular the bonnet lock. Preferably, the lever ratios and gear or mechanical ratios can be selected so that the lock holder can lift sufficiently to move into the secured position and at the same time increased force is provided for the purpose of closure against the sealing force.

In an advantageous manner, the ejector can be moved with a low gear or mechanical ratio during the movement of the lock holder from the lifting-off position into the secured position and the closure lever can be moved with a high gear or mechanical ratio during the movement of the lock holder from the secured position into the locking position. During lowering of the lock holder from the lifting-off position into the secured position, for example in the case of locking a bonnet, the force of the bonnet acts on the lock and in particular the ejector via the lock holder, so that the locking movement can be assisted by the additional load.

During this phase, the kinematics thus requires lower forces, so that, by means of a low gear or mechanical ratio, locking with low forces and a relatively high speed, which can also be described as passive lowering, can be carried out. During the electrical closure of a bonnet, for example, against a seal, high locking forces need to be introduced into the lock holder. A high gear or mechanical ratio during the active closure means that high forces can be generated on the lock holder. The low gear or mechanical ratio during the passive lowering means that a large amount of lift is generated on the lock holder while a small amount of lift is generated on the drive Bowden cable. Advantageously, by adjusting the gear or mechanical ratio, structurally advantageous kinematics equipped with a small number of components can be provided for electrically closing a lock and in particular a front bonnet of a motor vehicle.

Furthermore, the problem addressed by the invention is to provide a method by means of which improved locking of a door, hatch or bonnet can be made possible, in particular when the movable component has to be moved against the force of a seal, i.e. against different forces during the movement.

In terms of the method, the problem addressed by the invention is solved in that a method for locking an electrically actuable lock is provided, in which, by means of a drive lever mounted pivotally in a lock case, an ejector is first actuated by means of the drive lever so that a lock holder is moved from a lifting-off position into a secured position, and in which a closure lever is then moved by means of the drive lever so that the lock holder is moved from the secured position into a locking position. Owing to the separate execution of the first lowering by means of first lowering kinematics with the aid of an ejector and subsequent closure by means of a closure lever, different force ratios can be provided. In particular, the method can be adapted to the different requirements during the closure. Advantageously, the method can be achieved by the locking device described above.

BRIEF DESCRIPTION OF DRAWINGS

In the following, the invention will be explained in greater detail on the basis of a preferred embodiment with reference to the appended drawings. However, it should be noted that the embodiment does not limit the invention, but is merely one configuration thereof. The features set out can be implemented in isolation or in combination with other features of the description.

In the drawings:

FIG. 1 shows regions of a motor vehicle lock 1. The lock 1 comprises a lock case, a rotary latch 3, a pawl 4, a drive lever 5, an ejector 6, a closure lever 7, a catch hook 8 as well as two electrical controllers in the form of microdrives 9, 10. A lock holder 11 rests on the ejector 6, as a result of which the lifting-off position of the lock can be determined.

Figure 1:
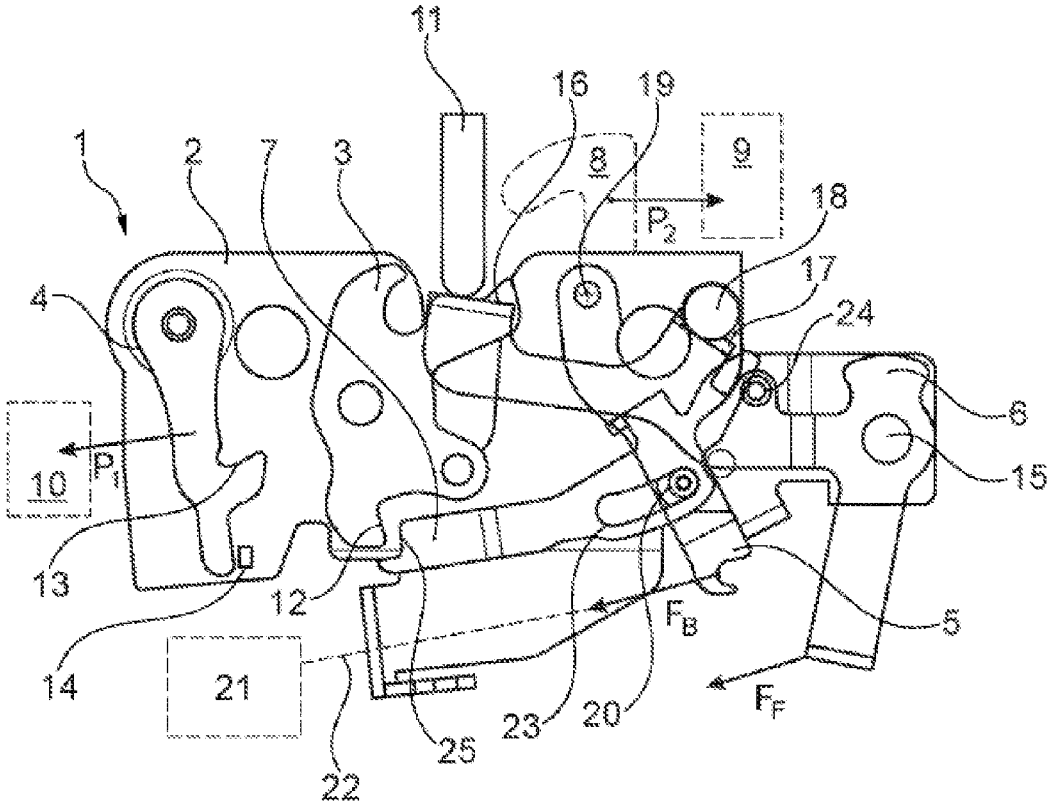
FIG. 1 is a partial side view of the motor vehicle lock according to the invention in a lifting-off position, with the lock holder resting on the ejector and a catch hook being out of engagement with the lock holder.

The rotary latch 3 and the pawl 4 form the locking mechanism, with the pawl 4 being able to latch into the rotary latch 3 and in particular into an extension 12. In this case, the extension 12 latches into a hook-shaped contour 13 of the pawl 4. In the present form, the pawl 4 is pre-tensioned in the counter-clockwise direction by means of a spring and rests against a stop 14 in the lock case 2, for example. By means of the controller 10, the pawl 3 can be moved in the direction of the arrow P1 in the clockwise direction. The controller may be a linear microdrive, for example, which can pivot the pawl 4 in the clockwise direction and thus move it into a position in which the pawl 4 comes out of engagement with the rotary latch 3.

The ejector 6 is received in the lock case 2 so that it can pivot about the shaft 15. The ejector 6 is preloaded in the clockwise direction by the force $F_F$ of a spring (not shown). The spring force $F_F$ retains the ejector 6 in the position shown in FIG. 1 so that the lock holder 11 and therefore a bonnet, for example, can be retained in the lifting-off position. The lock holder 11 is out of engagement with the rotary latch 3 and rests loosely on the ejector 6 and the rotary latch 3. The ejector 6 has a first contact surface 16 and a second contact surface 17. The lock holder 11 rests on the first contact surface 16, which may be formed by a beveled portion on the ejector 6, for example. The drive lever 5 acts on the second contact surface 17. The ejector may be manufactured from steel as a stamped sheet metal part, for example, with it being possible to provide the contact surfaces 16, 17 as beveled portions, for example.

The drive lever 5 acts on the ejector together with a catch 18. In turn, the drive lever 5 is received in the lock case 2 so that it can pivot about the shaft 19. Furthermore, the drive lever 5 comprises a support, closure and guide pin 20. The pin 20 serves to support the closure lever 7, to drive the closure lever 7, and at the same time acts as a guide pin 20 for the drive lever 5.

For example, the drive lever 5 is actuated by means of a closure drive 21 and by means of Bowden cable 22, which is for example merely shown by dashed lines. A force $F_B$ can be introduced into the drive lever 5 by means of the Bowden cable 22. The drive lever is thus moved about the shaft 19 in the clockwise direction by the closure drive 21.

The closure lever 7 comprises a guide groove 23, in which the pin 20 can be guided. The closure lever 7 may in turn rest against a pin 24 on the ejector 6 and thus may be guided securely in the lock 1. The closure lever 7 comprises a recess 25, which can be brought into interlocking engagement with the extension 12 of the rotary latch 3.

The catch hook 8 can be brought into engagement with the lock holder 11. Preferably, the catch hook 8 is spring-tensioned towards the lock holder 11 and would engage in the lock holder 11 without the electrical controller 9. The lock holder 11 is preferably designed as a bracket, so that the catch hook 8 can engage in the lock holder 11. In the embodiment shown, the catch hook 8 has been moved in the direction of the arrow P2 by the controller 9 and has in particular been pivoted in the clockwise direction in the direction of the arrow P2. The catch hook may be received in the lock case 2 or in a part of the lock case 2 that is not shown in a pivotally mounted manner. In particular by using the electrical controller 9, the option of opening the bonnet without manual intervention, i.e. automatically, is provided.

Figure 2:
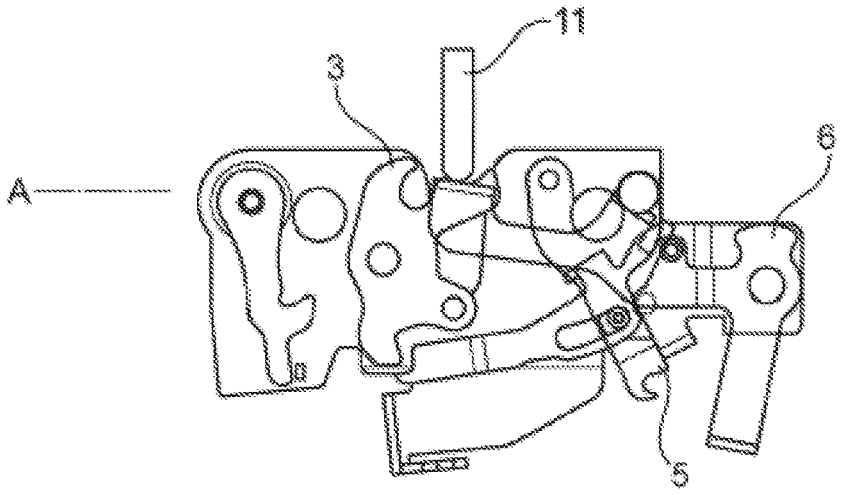
FIG. 2 shows the lock according to FIG. 1 in a lifting-off position.
Figure 3:
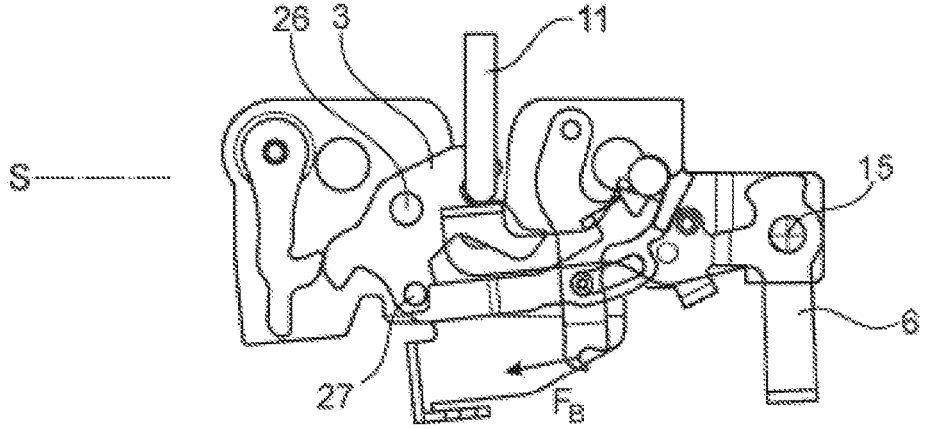
FIG. 3 shows the lock according to FIG. 1 in a secured position.
Figure 4:
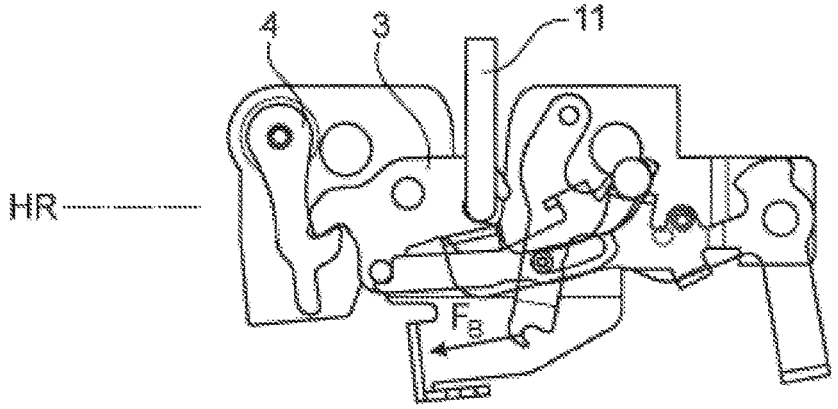
FIG. 4 shows the lock according to FIG. 1 in a locking position.

FIGS. 2, 3 and 4 show the closure process by the lock designed according to the invention on the basis of the lifting-off position in FIG. 2, the secured position in FIG. 3, and the locking position in FIG. 4. In this respect, FIG. 2 describes the starting position of the drive lever 5, FIG. 3 describes the movement of the drive lever 5 that the drive lever has carried out after a movement over approximately a third of its actuation travel, and FIG. 4 describes the position of the drive lever 5 when it has reached the end position, as an over-travel position or main ratchet position of the rotary latch, with the drive lever 5 having carried out actuation travel of approximately two thirds of its actuation travel.

In the lifting-off position A, the lock holder 11 rests on the rotary latch 3 and the ejector 6, with the lock holder 11 being retained in the lifting-off position A by the ejector 6 and partly also by the rotary latch 3, which is spring-loaded in the counter-clockwise direction. The drive lever 5 is in its starting position.

DETAILED DESCRIPTION

FIG. 3 shows the secured position S. The drive lever 5 has been pivoted in the clockwise direction by the closure drive 21 and in particular by the Bowden cable 22. By means of the pivoting movement, the ejector 6 has pivoted about its shaft 15 in the counter-clockwise direction, so that the lock holder 11, and in particular the lock holder 11 in combination with a load from a bonnet, moves into the secured position S. At the same time, the pivoting movement of the ejector 6 causes the rotary latch 3 to have pivoted about the shaft 26 in the clockwise direction through the lock holder 11, so that a cylinder pin 27 enters the engagement region of the recess 25 in the closure lever 7. In this secured position S, the rotary latch 3 comes into interlocking engagement with the lock holder 11 and the closure lever 7 comes into engagement with the pin 27. At the same time, the pin 20 reaches the end of the guide groove 23, as a result of which the guide pin 20 is capable of transferring a force to the closure lever 7.

FIG. 4 shows the main ratchet position HR or locking position HR of the locking mechanism in which the lock holder 11 is in the locking position. The rotary latch 3 is in engagement with the pawl 4, so that the locking mechanism is locked and the lock holder 11 is secured in its position. The locking position HR has been reached by the drive lever 5 having pivoted further in the clockwise direction due to the force $F_B$ of the closure drive 21. Owing to this movement, the pin 20 moves the rotary latch 3 into the locking position HR.

As can be clearly seen from FIGS. 2 and 3, by means of the drive lever and in particular the engagement ratios of the drive lever 5 on the ejector 6, a gear or mechanical ratio is provided, by means of which rapid, i.e. quick, lowering of the lock holder 11 can be made possible. Once the secured position S is reached, the drive lever primarily interacts with the closure lever 7, as a result of which a higher gear or mechanical ratio is produced and a high force can be provided for closing the rotary latch or for moving the lock holder 11 into the main ratchet position HR. Owing to the combination of, and in particular the interaction between, the drive lever 5, ejector 6 and closure lever 7, a more secure in line with the requirements, in particular of the sealing of a door, bonnet or hatch moved by the lock according to the invention, can be ensured.

LIST OF REFERENCE SIGNS

1 Lock
2 Lock case
3 Rotary latch
4 Pawl
5 Drive lever
6 Ejector
7 Closure lever
8 Catch hook
9, 10 Controller
11 Lock holder
12 Extension
13 Contour
14 Stop
15, 19, 26 Shaft
16 First contact surface
17 Second contact surface
18 Catch
20 Support, closure and guide pin
21 Closure drive
22 Bowden cable
23 Guide groove
24, 27 Pin
25 Recess
P1, P2 Arrow
$F_F$ Spring force
$F_B$

The invention claimed is:

1. A lock for a motor vehicle comprising:

a locking mechanism including a rotary latch and a pawl;

a lock holder;

an ejector for interacting with the lock holder, the lock holder being movable into a lifting-off position by the ejector;

an electrically actuatable drive for moving the lock holder from the lifting-off position into a locking position;

a drive lever, wherein the ejector and, at least indirectly, the rotary latch are engageable by the drive lever; and a closure lever, wherein the drive lever is moved by the electrically actuatable drive to cause the ejector to allow the lock holder to move from the lifting-off position into a secured position that is between the lifting-off position and the locking position, and an engagement between the drive lever and the closure lever causes the drive lever to move the closure lever to engage with the rotary latch, wherein further movement of the drive lever by the electrically actuatable drive moves the closure lever to move the lock holder from the secured position into the locking position via the engagement of the closure lever with the rotary latch, such that the rotary latch is moved to a position in which the locking mechanism locks the lock holder in the locking position, and wherein the drive lever has a guide pin and the closure lever has a guide groove in which the guide pin is received and movable along the guide groove.

2. The lock according to claim 1, wherein the electrically actuatable drive is a closure drive.

3. The lock according to claim 2, wherein the closure drive comprises a Bowden cable that is engageable with the drive lever.

4. The lock according to claim 1, wherein the drive lever is pivotally mounted in a lock case.

5. The lock according to claim 1, wherein the ejector is pivotally mounted in a lock case.

6. The lock according to claim 1, wherein at least a portion of the drive lever is guided in the closure lever.

7. The lock according to claim 1, wherein the ejector is moved with a low mechanical ratio during the movement of the lock holder from the lifting-off position into the secured position and the closure lever is moved with a high mechanical ratio during the movement of the lock holder from the secured position into the locking position.

8. The lock according to claim 1, wherein the ejector and the closure lever are moved by the drive lever at different mechanical ratios, the drive lever lifting by a third of its actuation travel during movement of the ejector and lifting by two thirds of its actuation travel during movement of the closure lever.

9. The lock according to claim 8, wherein the lock holder is moved by 18 mm during the movement into the secured position and the lock holder is moved by 6 mm during the movement into the locking position.

10. The lock according to claim 1, wherein the ejector is spaced from the drive lever.

11. The lock according to claim 10, wherein the ejector is biased into a position in which the lock holder is retained in the lifting-off position.

12. The lock according to claim 1, wherein the ejector has a first contact surface and a second contact surface formed as beveled portions of the ejector, wherein the lock holder is engageable against the first contact surface, and wherein the drive lever is engageable against the second contact surface.

13. The lock according to claim 1, wherein when the lock holder is moved into the secured position, the rotary latch is in engagement with the lock holder, the closure lever is in engagement with a pin of the rotary latch, and the guide pin reaches an end of the guide groove.

14. The lock according to claim 1, wherein the closure lever has a recess that is engageable with a pin of the rotary latch.

15. The lock according to claim 14, wherein the pawl has a hook-shaped contour that is engageable with an extension of the rotary latch when the lock holder is in the locking position, thereby locking the lock holder.

16. The lock according to claim 1, wherein the ejector has a pin, wherein the closure lever is engageable against the pin.

17. The lock according to claim 1 further comprising a catch hook that is engageable with the lock holder.

18. The lock according to claim 17 further comprising an electrical controller for moving the catch hook.

* * * * *